United States Patent [19]

Birmingham

[11] 3,957,930

[45] May 18, 1976

[54] CARBURETOR

[76] Inventor: James R. Birmingham, 9407 Muroc, Bellflower, Calif. 90706

[22] Filed: June 24, 1974

[21] Appl. No.: 482,567

Related U.S. Application Data

[63] Continuation-in-part of Ser. No. 212,325, Dec. 27, 1971, abandoned.

[52] U.S. Cl. ..... 261/44 R; 251/122

[51] Int. Cl.[2] ..... F02M 9/06

[58] Field of Search ..... 261/DIG. 21, 44 R; 251/DIG. 4, 122

[56] References Cited

UNITED STATES PATENTS

| | | | |
|---|---|---|---|
| 1,151,578 | 8/1915 | Entz | 261/44 R |
| 1,375,898 | 4/1921 | Ciglia et al. | 261/DIG. 38 |
| 1,399,065 | 12/1921 | Loomis | 261/DIG. 21 |
| 1,480,478 | 1/1924 | Taber | 261/DIG. 21 |
| 2,062,496 | 12/1936 | Brokel | 261/44 R |
| 2,136,959 | 11/1938 | Winfield | 261/36 A |
| 3,329,413 | 7/1967 | Date | 261/44 R |
| 3,330,543 | 7/1967 | Mennesson | 261/DIG. 38 |
| 3,414,244 | 12/1968 | Patterson, Jr. | 261/DIG. 38 |
| 3,528,787 | 9/1970 | Hallberg | 261/44 R |
| 3,709,469 | 1/1973 | Edmonston et al. | 261/44 R |
| 3,711,068 | 1/1973 | Perry | 261/41 B |
| 3,752,454 | 8/1973 | Korponay | 261/44 R |

*Primary Examiner*—Tim R. Miles
*Attorney, Agent, or Firm*—Albert L. Gabriel

[57] ABSTRACT

The present invention relates to a carburetor, and more particularly relates to an improved carburetor for a high-performance engine. Improved performance is provided in part by fixedly positioning the fuel dispensing element in an optimal location of the carburetor's airstream — regardless of how the airstream varies with the engine operation. Moreover, the disclosed carburetor has a structure that minimizes or eliminates internal flutter that previously produced inconsistent fuel flow. The disclosed carburetor further includes novel fuel purge valve means that is automatically operative upon engine shut-down to drain the remaining fuel from the carburetor so as to prevent flooding during subsequent start-up.

8 Claims, 12 Drawing Figures

FIG.1
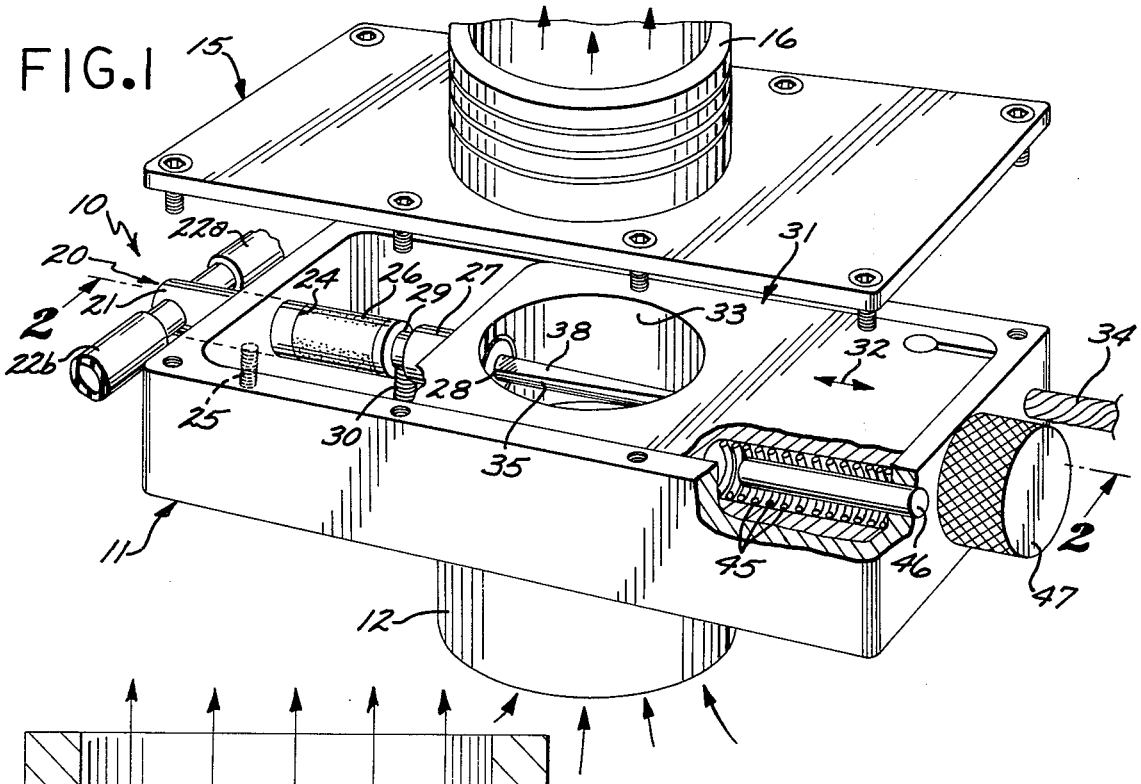
FIG.2
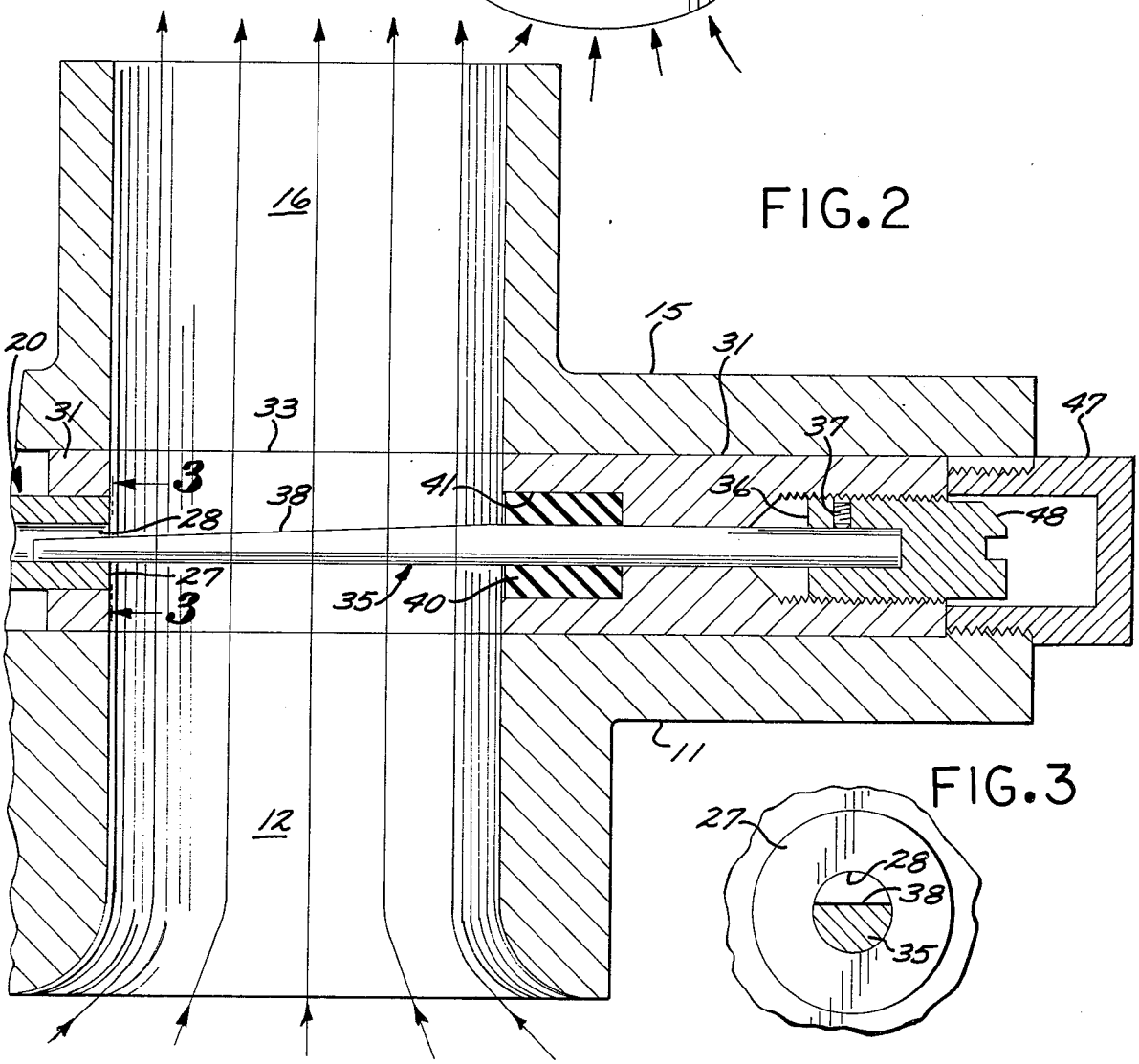
FIG.3

FIG. 4
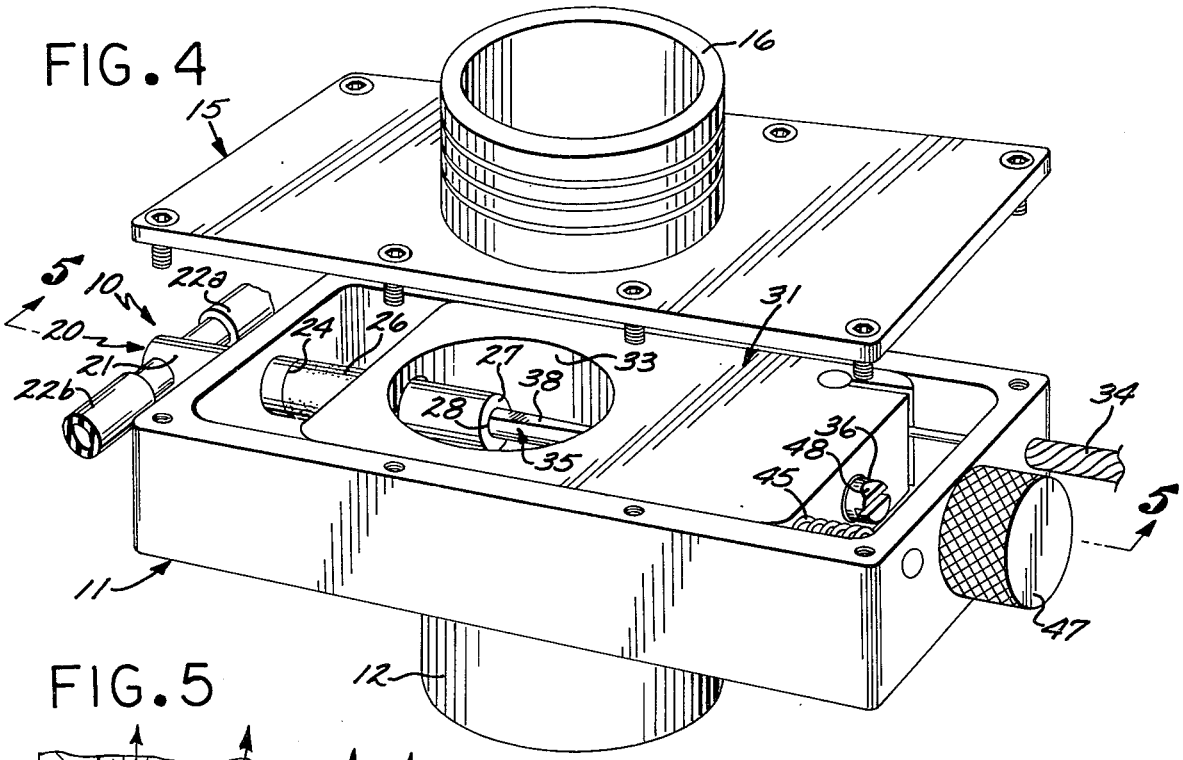
FIG. 5
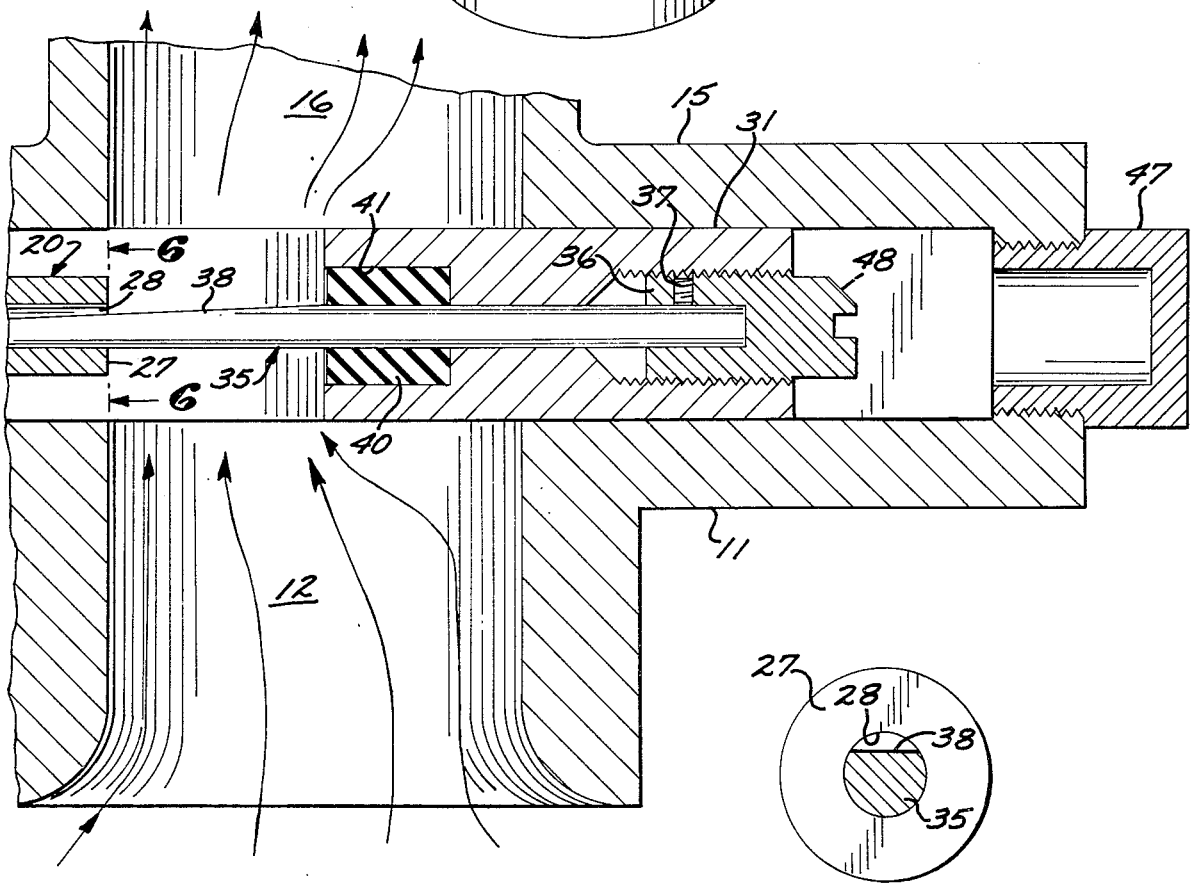
FIG. 6

CARBURETOR

RELATED APPLICATIONS

This is a continuation-in-part of my co-pending application Ser. No. 212,325, filed Dec. 27, 1971 for CARBURETOR, now abandoned.

BACKGROUND OF THE INVENTION

It is well known that gasoline-type internal combustion engines develop their power by the "combustion" of a mixture of gasoline and air (actually, more specifically by the combustion of gasoline in the presence of oxygen in the air). It therefore follows that in order to obtain more power, it becomes necessary to burn larger amounts of gasoline in the presence of larger volumes of air. Moreover, it is also known that different proportions of gasoline and air are required for different types of engine operation, i.e., for idling, for acceleration, etc. The desired gasoline/air mixture is produced by means of a "carburetor" that automatically provides the desired amount of gasoline and air for normal driving, for acceleration, for hill climbing, and for sustained speeds, etc.

For high performance engines such as are used for racing motorcycles or the like, a unique type of carburetor has been developed, this particular type of carburetor being adapted to operate at any angular orientation, for both the initial installation, and for various angles that a motorcycle may assume during its operation.

OBJECTS AND DRAWINGS

It is therefore the principal object of the present invention to provide an improved carburetor.

It is another object of the present invention to provide an improved carburetor for high performance engines.

It is a still further object of the present invention to provide an improved carburetor that is adapted for various angular installations.

It is a further object of the present invention to provide an improved carburetor that provides improved "metering" of gasoline.

It is a still further object of the present invention to provide an improved carburetor for use on high performance internal combustion engines of the type used on motorcycles.

An additional object of the invention is to provide, in a carburetor of the character described, novel fuel purge valve means responsive to intake vacuum which is open upon engine shutdown so as to drain remaining fuel out of the carburetor and thereby prevent flooding during subsequent start-up, but which automatically closes during engine cranking and operation.

The attainment of these objects and others will be realized from a study of the following description, taken in conjunction with the drawings, of which:

BRIEF DESCRIPTION OF THE DRAWINGS

FIG. 1 shows an exploded pictorial view of the subject carburetor in its high speed state;

FIG. 2 shows a cross-sectional view of the subject carburetor in its high speed state;

FIG. 3 shows a cross-sectional view of the gasoline-metering arrangement during the high speed state of the carburetor;

FIG. 4 shows an exploded pictorial view of the subject carburetor in its medium speed state;

FIG. 5 shows a cross-sectional view of the subject carburetor in its medium speed state;

FIG. 6 shows a cross-sectional view of the gasoline-metering arrangement during the medium speed state of the carburetor;

SYNOPSIS

Figure 7:
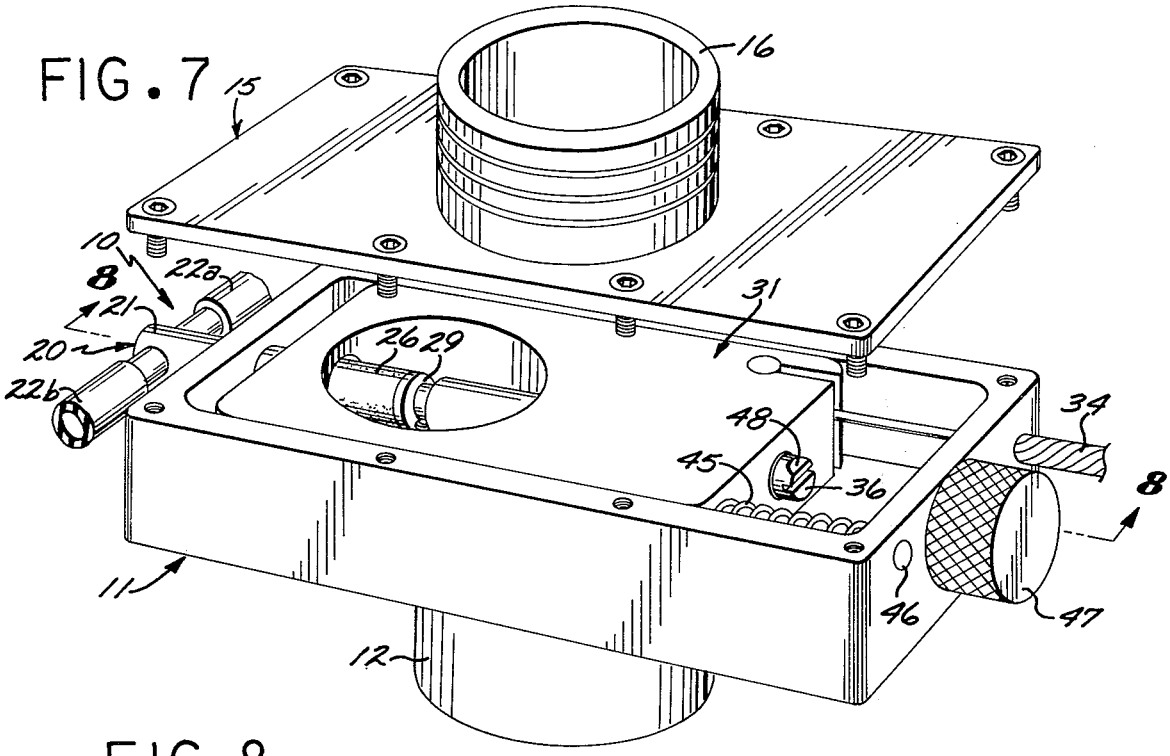
FIG. 7 shows an exploded pictorial view of the subject carburetor in its shut-off state.

Broadly stated, the disclosed carburetor has a positionable throttle block, a tapered fuel metering pin being affixed to this positionable throttle block so that the metering pin is also positionable. The metering pin is adapted to slide into and out of a fixedly positioned fuel dispensing tube having an alignment sector that automatically aligns the fuel tube with the metering pin when such alignment is necessary.

The fuel tube has a circular bore for receiving the metering pin; the fixedly positioned fuel dispensing bore acting to support the metering pin and to thus minimize flutter of the metering pin during high speed operation. Moreover, the disclosed carburetor uses a fixedly positioned fuel tube so that the fuel line connections to the fuel tube may also be fixedly positioned, thus minimizing problems associated with fuel line flexing and fuel line spacing. In addition, the disclosed carburetor has a fuel inlet that is angularly positionable to accept fuel lines that approach in optimal directions. Furthermore, the fuel inlet provides an arrangement for improved fuel flow and for more balanced operation of the carburetor.

An additional feature of importance in the disclosed type of carburetor having a throttle block that is slidable in a generally closed housing chamber, is a fuell purge valve responsive to the vacuum condition within the housing chamber which opens to drain remaining fuel from the chamber upon engine shut-down to prevent flooding during subsequent start-up, and which automatically closes upon engine cranking to re-seal the housing chamber for normal carburetor operation.

DISCLOSURE

The Overall Carburetor

As pointed out above, an internal combustion engine uses a carburetor for providing a combustible mixture of gasoline and air, the instantaneous amount of gasoline being the primary determinant of the power being developed at a particular instant. Moreover, the carburetor should provide the desired combustible mixture instantaneously upon demand.

The operation of the subject carburetor will be understood from FIG. 1 which is a partially exploded representation of the subject carburetor in its "high speed state. FIG. 1 shows a carburetor 10 having a body 11 provided with an air throat 12 that is preferably internally flared to facilitate the inflow of air, as indicated by the inflow air arrows.

FIG. 1 also shows a closing plate 15 of the carburetor 10 to have an air outflow pipe 16, the closing plate 15 being affixed to the body of the carburetor by suitable means such as screws, bolts, or the like. The carburetor proper is attached to the engine by means of a suitable connector (not shown), such as a flange that is attached to the air outflow pipe 16, and to the engine — the connector taking a form suitable for that particular engine.

As is well known, the movement in the cylinder(s) of the internal combustion engine produces a partial vacuum that causes a stream of air to enterr the flared air intake throat 12, to flow through the carburetor 10, to exit from the air outflow pipe 16, and to then enter the engine. In this way, the air intake throat 12 and the air outflow pipe 16 form an "airstream passageway", and since any particular engine can utilize only a given volume airstream, the size of the air passageway is designed to handle this given volume of air.

In a manner to be discussed later, the airstream picks up a suitable amount of gasoline so that the carburetor thus produces a gas-laden airstream, which for convenience will be called the "combustible gasoline/air mixture" that is fed to the engine.

The Fuel Tube

It was pointed out above that, at any given instant, the amount of gasoline available to the engine controls the engine speed and thus the engine power. In order to provide fuel flow to the engine, the carburetoor 10 has a fuel tube 20 that has a T-shaped fuel inlet 21 having fuel lines **22*a* and 22*b* affixed to the ends of the T-shaped fuel inlet 21. Fuel thus flows from the fuel tank (not shown) through the fuel lines 22*a* and 22*b* into the fuel inlet 21. The advantages of the T-shaped fuel inlet 21** will be discussed later.

Fuel tube 20 has its stem portion 24 affixed to the body 11 of the carburetor 10 by any suitable means, such as a setscrew 25 so that the fuel tube 20 is fixedly and securedly held in place but may, under conditions to be discussed later, be rotated to optimal orientations. Thus, the fuel tube 20 is adapted to provide a flow of fuel into the carburetor.

Fuel tube 20 has an alignment sector 26 that may be a length of tubing formed of a fairly rigid, but flexible material, such as Neoprene, Teflon, or Urethane. The function of the alignment sector 26 will be discussed more fully later.

Fuel tube 20 also has a metering element 27 that is preferably formed of a metallic cylinder or rod that has a precisely diametered axial bore 28. The function of the metering element 27 and its axial bore 28 will be also discussed later.

Metering element 27 is shown to have a peripheral groove 29 that is sized and positioned to receive a locking stud 30 that fits into peripheral groove 29 to establish the longitudinal position of the metering element 27, but still permits the fuel tube 20 to be rotated, and to flex transversely as necessary. These functions will also be discussed later.

The Throttle Block

Carburetor 10, as shown in FIG. 1, contains a throttle block 31 that is adapted to be positioned longitudinally, as indicated by the double-ended arrow 32, in the carburetor body 11. The throttle block 31 is indicated in FIG. 1 to be in its extreme rightward location, being held in this location by means such as a speed control cable 34 working against a bias spring 45. This extreme rightward position of the throttle block 31 causes the throttle block airstream opening 33 to be in alignment with the airstream passageway formed by the air intake throat 12 and the air outflow pipe 16. With the throttle block 31 in this illustrated location, a maximal volume of air is thus permitted to flow through the air passageway to the engine.

It will be seen from FIG. 1 that the throttle block 31 contains tapered metering pin 35 that is mounted therein by means that will be explained later, so that the metering pin 35 is firmly mounted in the positionable throttle block 31, and the tapered end of the metering pin 35 fits into the axial bore 28.

The High Speed State

FIG. 2 shows a partial cross-sectional view of the carburetor in its high speed state, as discussed above. In FIG. 2, the throttle block 31 is indicated to be in its extreme rightward location, its airstream opening 33 being aligned with the air intake throat 12 of the carburetor body 11, and being further aligned with the air outflow pipe of the closing plate 15. In this position, the resultant alignment of the airstream opening and the airstream passageway permits the unimpeded flow of a maximal volume of air, which corresponds to the high speed stae. It will also be noted from FIG. 2 that the airflow as indicated by the arrows, tends to be a smooth "laminar" type of flow; this too, will be discussed later.

FIG. 2 also illustrates the metering pin 35 and its fla tapered portion 38. The distal end of the metering pin 35 is shown as being fastened into a fine-threaded rotatable insert 36, and being held by means such as a setscrew 37.

The center portion of the metering pin 35 is held by an "interference fit" with a retainer 40, of Neoprene, Urethane, or the like, retainer 40 being force-fitted into a suitable recess 41 of the throttle block 31. Sealing retainer 40 actually provides a dual function, the first of which is to provide the interference fit that supports the center portion of the metering pin 35. It has been found desirable in one embodiment of the invention to use a tubular retainer 40 that is about 7/16 inch in diameter, compressed into a bore 41 about 27/64 inch in diameter, the retainer being about 11/32 long and having an axial tunnel diameter of about 0.080 inch. Since the diameter of the untapered round portion of metering pin 35 in the said embodiment is about 0.125 inch, it forms a tight interference fit in the axial tunnel of the retainer 40. The tight interference fit between the retainer 40 and the metering pin 35 securely holds the central portion of the metering pin 35, this being advantageously for reasons that will be discussed later.

Moreover, as indicated in FIG. 2, the tapered tip of the metering pin 35 fits into the axial bore of the metering element 26, the tapered flat portion of the metering pin providing a large space that permits fuel to flow freely out of the axial bore of the fuel tube 20, to be aspirated into the moving airstream. The amount of fuel flow from the axial bore 28 is determined by the cross-sectional area of the tapered metering pin where it "engages" the axial bore 28 of the metering element 27.

FIG. 3 indicates that for the high speed state, the cross-sectional area of the metering pin 35 at the engagement point with the axial bore 28 is slightly more than one-half of the cross-sectional area of the axial bore 28 of the metering element 27. Under this condition, a maximal amount of fuel flows into the carburetor.

As the airstream rushes through the air passageway, and past the metering element 27 of the fuel tube 20, the moving air picks up the flowing fuel to form the combustible mixture previously discussed and this fuel-rich combustible mixture now enters the engine. Thus, the illustrated position of the throttle block 31 not only provides a maximal amount of air but also provides a maximal amount of fuel, and thus establishes the high speed state of the carburetor.

It should be noted that the fixed position of the fuel-dispensing axial bore is such that it is at the laminar flow portion of the airstream in the air passageway, as indicated by the airflow arrows, and thus operates to provide a smooth, consistent flow of fuel into the carburetor.

The Flutter Problem

Attention is directed to the fact that, as may be understood from the previous discussion of FIG. 2, a rapidly moving airstream rushes through the air passageway of the carburetor. This air movement tends to produce high frequency vibrations or "flutter" of the metering pin 35. These high frequency vibrations of the metering pin are undesirable for the following reason.

If the tip of the metering pin 35 that is positioned within the axial bore 28 of the metering element 27 begins to vibrate, the vibration obviously interferes with the smooth flow or fuel out of the metering element 27, and thus tends to introduce an inconsistency into the operation of the engine due to the fluctuating amount of fuel that is carried into the engine.

It should be noted that the present invention is such that these high frequency vibrations of the metering pin 35 are minimized or eliminated. As will be seen from FIG. 2, most of the metering pin is securely mounted in the throttle block 31. Moreover, the center portion of the metering pin 35 is securely held by the retainer 40, the above discussed interference fit assuring that the center portion of the metering pin 35 is held securely. In addition, the tip of the metering pin 35 is received into the axial bore 28, and as indicated in FIG. 3, the spatial relationship between the metering pin 35 and the axial bore 28 is such that the tip of the metering pin 35 is securely held against movement thereof.

While there is some flexibility of the fuel tube 20 due to the flexible alignment sector 26, this flexibility is of the low frequency type, and does not affect the flow of fuel into the carburetor.

Thus, the disclosed invention has a structure that minimizes or obviates the problem of high frequency flutter of the metering pin.

The Medium Speed State

As indicated above, a large fuel flow produces high engine speed and a current high engine power, and in order to slow down the engine, and to reduce its power, it therefore becomes necessary to control the amount of combustible gasoline/air mixture provided to the engine. This result is achieved by "throttling" the engine, i.e., by limiting the air, fuel, and combustible mixture admitted into the engine.

The throttling action may be understood from FIG. 4 which shows an exploded pictorial view of the carburetor 10 in its medium state. In FIG. 4, the throttle block 31 is shown to have been moved to an intermediate location by use of speed control cable 34 and bias spring 45. Its airstream opening 33 is now only partially aligned with the air intale throat 12 and the air outflow pipe 16, so that the airstream passageway is partly throttled to produce the flow of a limited volume.

In addition to throttling the airflow, the intermediate throttle block position of FIG. 4 has an additional effect, namely, that of reducing the amount of fuel that is available for instantaneous engine operation. It may be seen that in FIG. 4 the metering pin 35 is partially inserted into the metering element 27 of the fuel tube 20, and it will be recalled that the amount of fuel flow is determined by the cross-sectional area of the metering pin 35 at the point at which it engages the axial bore 28 of the metering element 27 of the fuel tube 20. The effect of this partial insertion of the metering pin will be understood from FIG. 5.

FIG. 5 is a partial cross-sectional view of the medium speed state of the carburetor 10, and illustrates the throttle block 31 to be in the intermediate throttling location discussed above, with its airstream opening 33 in only partial alignment with the air passage formed by throat 12 and pipe 16. Moreover, the metering pin 35 is shown to be more deeply inserted into the axial bore 28 of the metering element 27, and the cross-sectional area of the metering pin 35 at the engagement point with the metering element 27 is somewhat larger than previously shown. Therefore, the tapered flat portion 38 of the metering pin 35 now provides a smaller space for the outflow of fuel from the metering element 27 of the fuel tube 20.

FIG. 6 indicates that the cross-sectional area of the metering pin 35 at the illustrted engagement point is almost equal to the cross-sectional area of the axial bore 28 of the metering element 27. Under this medium speed condition, only a limited amount of fuel flows into the carburetor.

In the same manner as indicated above, as the airstream moves past the metering element 27 of the fuel tube, the moving air picks up the flowing fuel to form the combustible mixture. However, due to the limited volume of air movement produced by the throttling action, due to the lower velocity of the airstream, and due to the reduced amount of fuel flowing from the fuel tube, the combustible mixture now produces a medium speed, medium power state.

Thus, the medium speed state of the carburetor limits both the amount of fuel flow and the volume of air, and in this way of operation of the engine may be controlled.

It will be noted from FIG. 4 that the airstream no longer has the smooth laminar-type flow discussed previously. Rather, there is a turbulent type of airflow adjacent to the edge of the throttling airstream opening 33. It will be noted however that the metering element 27 is positioned in the air passageway at the edge of the laminar-type airflow, so that the fuel dispensing axial bore is again in an optimal portion of the airstream that encourages consistent fuel flow from the fuel flow from the fuel metering element 27.

In this way, the movement of thee throttle block 31 and its attached metering pin 35 continually throttles the carburetor to a greater or lesser extent, completely under the control of the operator.

Mixture Control

It has been found desirable to provide each carburetor with a set of metering pins 35 that have different tapers. Thus, while all of the metering pins produce the desired fuel shutoff condition, each of the metering pins provides a slightly different rate of gasoline flow for different settings of the throttle block. In this way, an engine that is adapted to take a larger or a smaller amount of fuel may be provided with a metering pin having a shallower or sharper taper, resulting in mixtures of desired proportions of fuel and air.

Rotation of the threaded insert 36 (see FIGS. 2, 5, and 8) causes the metering pin 35 to be advanced or retracted relative to the throttle block 31 to permit slight adjustment of the high speed and cutoff conditions.

It has also been found that the angular orientation of the flat portion 38 of the metering pin 35 has a bearing on the mixture and on the low speed operation. When the flat portion 38 of the metering pin 35 is positioned toward the engine (as illustrated), a somewhat larger amount of fuel is drawn through the fuel tube 20, apparently because of a somewhat greater "venturi" effect; whereas when the flat portion 38 of the metering pin 35 is positioned away from the engine, toward the incoming air, a somewhat smaller amount of fuel is drawn through the fuel tube 20, apparently because the pressure of the incoming air retards the flow of fuel from the carburetor.

The engine operator can take advantage of this characteristic by removing cap 47 and rotating the threaded insert 36 to the optimal angular orientation, the fine thread of the insert 36 permitting an adjustment of the flat orientation without appreciably disturbing the longitudinal position of the metering pin 35. The particular angular orientation of the flat portion of the metering pin may be indicated by the position of the chamfer 48 on the insert 36, the chamfer being aligned with the flat portion 38 of the metering pin 35. Thus, the carburetor may be tuned externally by means of a simple screwdriver adjustment.

The Cutoff State

FIG. 7 pictorially illustrates the cutoff state of the carburetor. Here, the throttle block 31 is shown to have been moved toward the extreme leftmost position under the urging of the helical vias spring 45 and a spring positioning rod 46. When the throtte block 31 is in the illustrated position, it prevents the flow of air through the airstream passage formed by throat 12 and pipe 16, thus completely throttling the engine.

Moreover, in the cutoff state the entire tapered portion of metering pin 35 is received within the fuel tube 20, as will be discussed later. As a result, the untapered round portion of the metering pin 35 now engages the axial bore 28 of the metering element 27 thus effectively shutting off the flow of fuel from the fuel tube 20.

Figure 8:
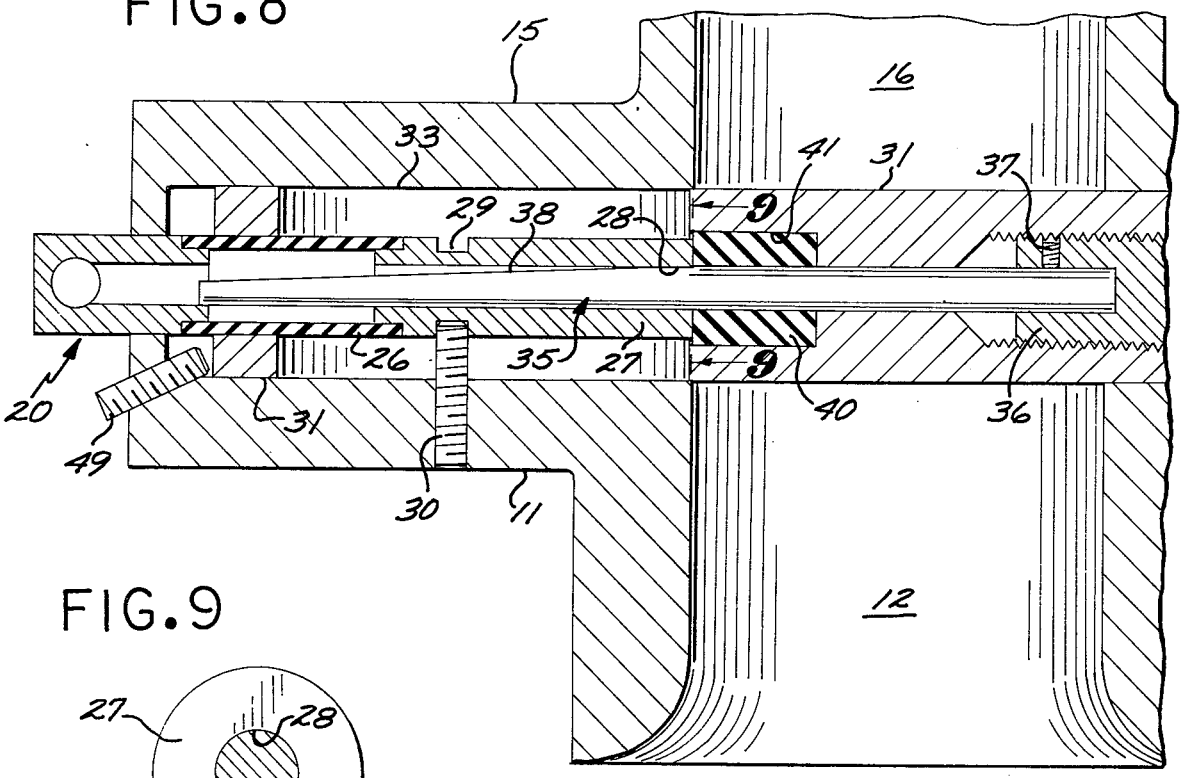
FIG. 8 shows a cross-sectional view of the carburetor in its shut-off state.

The cross-sectional view of FIG. 8 shows the throttle block to be in the extreme leftmost cutoff location with its airstream opening 33 in complete misalignment with the air passageway formed by throat 12 and pipe 16, so that air movement through the carburetor is completely throttled.

FIG. 8 also shows the metering pin 35 to be completely received into the fuel tube 20 so that the full diameter of the metering pin engages the axial bore 28 of the metering element 27 thus preventing the outflow of fuel from the fuel tube 20.

Figure 9:
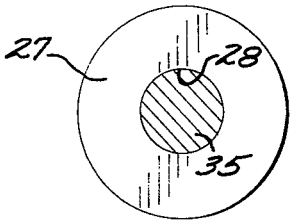
FIG. 9 shows a cross-sectional view of the gasoline-metering arrangement during the shut-off state of the carburetor.

The cross-sectional relationship of the engages metering pin 35 and the axial bore 28 of the metering element 27 is shown in FIG. 9.

Cold Starts

Experience has shown that the disclosed carburetor does not need a "choke" for cold starting. The most satisfactory procedure is to momentarily open the carburetor to its high speed state, thus permitting fuel to flow from the fuel tank through the now open metering element 27 into the carburetor. In fact, if the carburetor is held open for too long a time interval, the engine may be "flooded". However, with the addition of the fuel purge valve, illustrated in FIGS. 10–12 and described in detail hereinafter, any such flooding will be quickly relieved.

An additional fuel shutoff is provided which will be more fully understood by directing attention back to FIG. 8. It will be seen that the outer end of the metering element 27 is now pressured abutment with the face of the sealing retainer 40, this abutment involving the flat end of the metering element 27 and the flat face of the sealing retainer 40. It should be noted that the abutment pressure is absorbed by the engagement of the peripheral groove 29 and the locking stud 30. Thus, even the slightest trickle of fuel from the fuel tube 20 is prevented. In this way, the engine is completely shut off the throttling the airstream completely and by preventing the flow of fuel from the fuel tube 20.

Self Alignment

It will be noted that in the normal use of the carburetor, the metering pin 35 continually slides into and out of the fuel tube 20 depending upon the instantaneous position of the throttle block 31 as controlled by the operator. It will also be noted from FIG. 8 that the flexible alignment sector 26 of the fuel tube 20 permits the metering pin 35 to easily enter and leave the fuel tube 20 regardless of any slight misalignment that may be present. Thus, the alignment sector 36 automatically provides self-alignment whenever such alignment is necessary and also facilitates manufacturing by easing the tolerances.

It has been found that a material such as Teflon best withstands the action of both gasoline and exotic fuels such as alcohol with nitrites, etc., while still retaining the desired flexibility and long life.

Idle Adjustment

Such motorcyclists prefer to have complete control over the carburetor setting, this control ranging from the high speed state to the shutoff state, the latter of which may be desirable to prevent a fire in case of an accident. However, many other motorcyclists prefer to have an "idle" engine setting at which the engine will run at the desired low speed. This idle control is easily achieved by use of an idle adjustment screw 49 of FIG. 8 that is placed in such a position that it can prevent the throttle block 31 from moving to its leftmost shutoff position.

Fuel Connections

It was pointed out above that the fuel tube 20 had a T-shaped fuel inlet 21. This type of fuel inlet has the following advantages. When the engine obtains its fuel from a single fuel tank, the fuel may be fed from the tank to the carburetor by means of two independent fuel lines 22*a* and 22*b* connected to the two ends of the T connection, thus permitting improved fuel flow to the carburetor, especially in the case of gravity feed fuel systems.

In those cases where the engine has two carburetors, one end of each of the T-shaped fuel inlet connections may be connected directly to the tank and the other ends of the T-shaped connections may be interconnected. In this way the two carburetors are balanced for optimal operation.

Moreover, when it happens that the fuel lines 22 approach the fuel inlet 20 from an unusual angle, the fuel inlet 20 may be rotated to correspond to the approach style, whereupon the setscrew 25 may be retightened to hold the fuel inlet 20 at its new angular orientation. It will be noted that the peripheral groove 29 and locking stud 30 permit this angular reorientation of the fuel inlet 20. Thus, the now fixedly positioned fuel inlet 20 accepts rigid fuel lines that may be routed and strapped down as desired.

The Purge Valve

Figure 10:
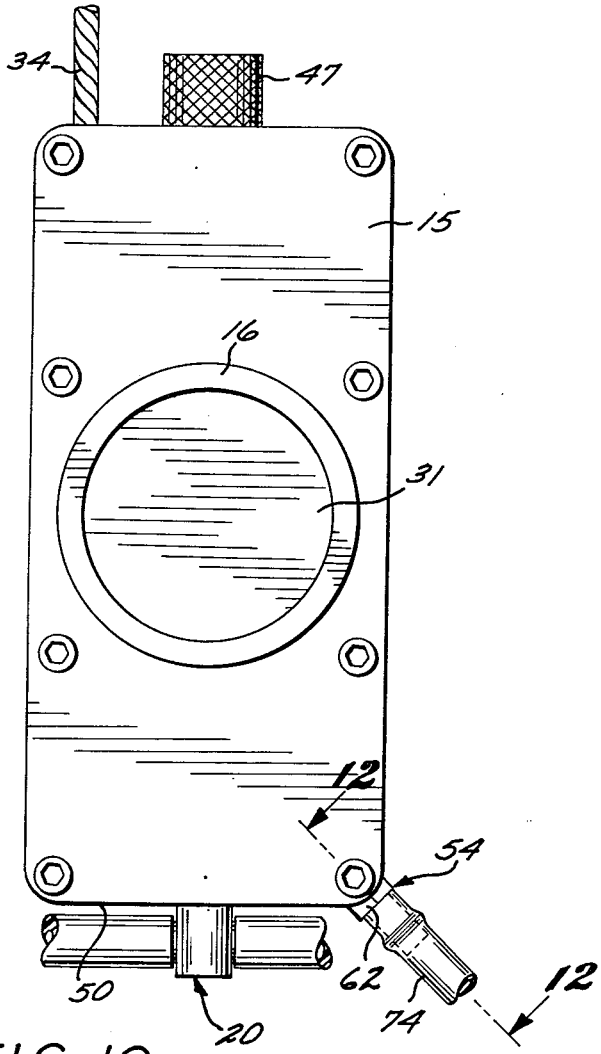
FIG. 10 is a front elevational view of a carburetor like that shown in FIGS. 1–9, which includes vacuum-responsive fuel purge valve means.
Figure 11:
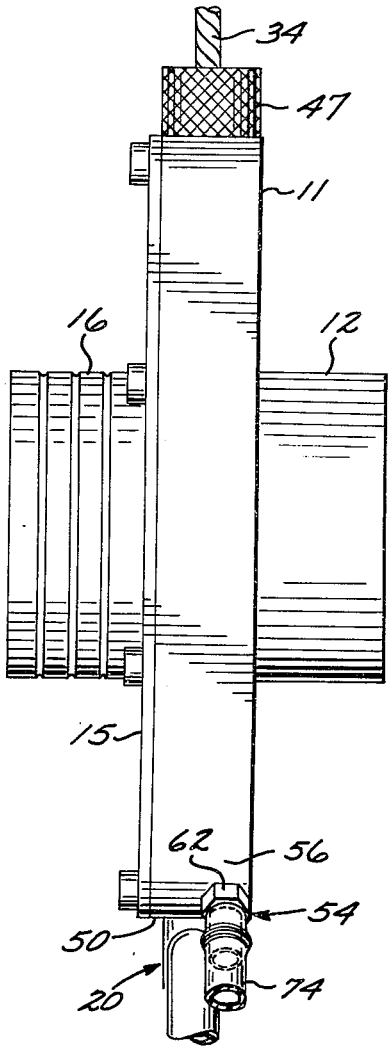
FIG. 11 is a side elevational view of the carburetor shown in FIG. 10.
Figure 12:
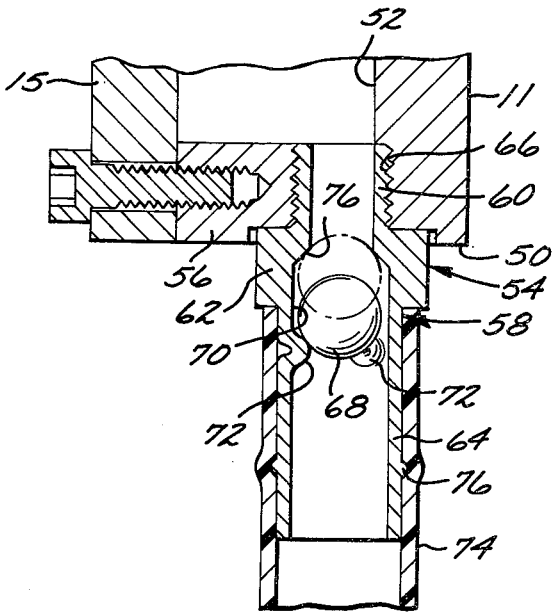
FIG. 12 is an enlarged, fragmentary sectionala view taken on the line 12—12 in FIG. 10.

In FIGS. 10-12 of the drawings, the carburetor 10 is illustrated in a typical installed orientation wherein the elongated body 11 and cover plate 15 are generally vertically oriented, with the end 50 of the carburetor that has fuel tube 20 therein located at the bottom. The body 11 and cover plate 15 together define vertically elongated carburetor chamber 52.

The fuel purge valve is generally designated 54, and it comprises a check valve disposed in a threaded tubular fitting that is engaged in a threaded bore through a wall 56 of body 11 proximate the lower end 50 of the carburetor, so as to communicate with the lowermost region of carburetor chamber 52.

Referring particularly to FIG. 12 which shows the details of a presently preferred form of the purge valve 54, the valve 54 includes a tubular body 58 having an externally threaded upper mounting end portion 60, an intermediate hexagonal nut portion 62, and a lower sleeve portion 64. The threaded upper end portion 60 is threadedly engaged in complementary threaded bore 66 that extends through the wall 56 of body 11, and the nut portion 62 is employed to tighten the body 58 of the valve into position.

In the illustrated embodiment, the valve element is a ball 68 which freely floats within annular valve chamber 70 located within the valve body 58. The ball 68 is shown in solid lines in FIG. 12 in its lowermost position, which is the open condition of valve 54, wherein the ball 58 rests upon three detents 72 regularly spaced about the inner circumference of the sleeve portion 64. Valve 54 is in this open condition when the engine is shut down, and by communicating with the lowermost region of carburetor chamber 52 it permits substantially all liquid fuel remaining after engine operation to drain out through the valve 54 so as to prevent flooding upon subsequent start-up of the engine. A flexible plastic fuel drain line 74 has its upper end portion engaged over the sleeve portion 64 of valve body 58, being secured by external annular bead 76 on sleeve portion 64, the drain line 74 extending down to an open lower end (not shown) located below the engine to assure that purged fuel will flow onto the ground and not the engine.

In practice, the volume of liquid fuel required to be purged upon engine shut-down is actually very small, so that the valve body 58 and drain line 74 may be quite small in diameter, as for example approximately ¼ inch.

The lowermost region of carburetor chamber 52 proximate the end 50 of the carburetor communicates with the carburetor throat 12 and outflow pipe 16, and hence with the engine air/fuel intake system, by way of the tolerances between the throttle block 31 and the walls defining chamber 52 of the one hand, and between the throttle block 31 and the fuel metering element 27 and its alignment sector 26 on the other hand. Through such communication, the instant enging cranking is commenced the resulting partial vacuum in the engine intake system will be applied to the upper surface of ball valve 58, and the resulting pressure difference between this and atmospheric pressure acting on the lower surface will shift the ball valve element 68 to its uppermost, closed position shown in phantom in FIG. 12, wherein the ball 68 seals the valve against any outflow of fuel or inflow or air therethrough against annular valve seat 76 in valve body 58. The valve will remain in this closed condition as long as the engine operates, but will automatically re-open to drain any remaining liquid fuel when the enging is again shut down and the engine intake system no longer maintains its partial vacuum condition.

While FIGS. 10–12 show carburetor orientation and purge valve positioning for a typical carburetor installation, it is to be understood that the carburetor may be oriented in any other desired operative position, in which case the fuel purge valve 54 will always be installed so as to communicate with the lowermost region of carburetor chamber 52.

Prior Art

Most prior art carburetors of the subject type, as exemplified by the British-made "Gardner" carburetor, and by the carburetor disclosed in U.S. Pat. No. 3,709,469 of Edmonston for "Carburetor", have a construction that causes the exit end of the fuel tube to move progressively across the airstream. This prior art structure has the disadvantage that the exit end of the fuel tube is therefore exposed to varying pressures and various types of flow of the airstream as the carburetor is throttled, leading to somewhat inconsistent fuel flow conditions.

In addition, these prior art carburetors also mounted the fuel tube in such as way that it moved relative to the carburetor body, this prior arrangement requiring flexible fuel lines that were susceptible to the possibility of leakage and breakage. Moreover, the prior art movement of the fuel tube and the flexible fuel lines also required suitable space, and this requirement often raised a problem on small motorcycles, and on motorcycles that have a lot of equipment thereon.

Another disadvantage of these prior art carburetors was that their metering pins tended to be mounted in such a manner that they fluttered in the airstream, thus producing undesirable fluctuations of the fuel flow conditions, particularly at the high speed state.

SUMMARY

The disclosed invention has a number of important features, one of the most important of which is that the fuel-dispensing bore is fixedly positioned at the optimal location of the air passageway, so that it always dispenses fuel at a predetermined and predictable manner. In this way, consistent fuel flow is provided whether the engine is running at a high speed, at a low speed, or at idling speed. The metering pin of the present invention is securely held at its far end and at its central portion. Moreover, its tip is supported by the fuel dispensing bore, in this way obviating the problem of metering pin flutter and vibration. Furthermore, the present invention uses a fixedly positioned fuel tube, which permits the use of fixedly positioned fuel lines, thus minimizing the problem of fuel line breakage and fuel line fraying, and permitting fuel line installation in a smaller space. The fuel tube contains an alignment sector that facilitates the movement of the metering pin therein and eases manufacture of the carburetor by reducing the necessary tolerances. In addition, the disclosed fuel inlet is angularly positionable, thus permitting the fuel lines to approach the carburetor from their own optimal direction. The fuel inlet also has two inputs that permit improved fuel flow and a better balanced operation. In this way, the disclosed carburetor provides improved operation of the engine, particularly at high speeds.

While the instant invention has been shown and described herein in what is conceived to be the most practical and preferred embodiment, it is recognized that departures may be made therefrom within the scope of the invention.

I claim:

1. A carburetor comprising:

means defining an air passageway, for directing an airstream;

a movable throttle block having an airstream opening therein and movable across said passageway;

a tapered metering pin carried by said movable throttle block and extending across said opening from one side thereof through a lateral aperture in the other side of said opening; whereby said metering pin is also movable with said throttle block;

means, comprising a fixedly positioned fuel tube extending through said aperture and having a metering element incorporating a fuel dispensing bore telescopically embracing said metering pin, for dispensing fuel into said airstream;

said fuel dispensing bore being fixedly positioned in predetermined relation to said air passageway;

said fuel tube comprising a flexible tubing alignment sector;

means for moving said throttle block for causing said airstream opening to throttle said airstream to a given extent, and for causing a selectable section of said tapered metering pin to occupy said bore of said fixedly positioned fuel tube, for metering a given amount of fuel into said airstream in accordance with the position of said block;

and a sealing means movable with said block and surrounding said metering pin at said one side of said opening and being sealably engageable with said fuel dispensing bore when said throttle block is moved to a position closing said air passageway.

2. A carburetor comprising:

means, comprising an air passageway, for establishing an airstream;

a positionable throttle block having an airstream opening therein;

a tapered metering pin mounted in said positionable throttle block;

whereby said metering pin is also positionable;

means, comprising a fixedly positioned fuel tube having a metering element incorporating a fuel dispensing bore, for dispensing fuel into said airstream;

said fuel dispensing bore being fixedly positioned in a predetermined location of said air passageway;

means for positioning said throttle block for causing said airstream opening to throttle said airstream to a given extent, and for causing a selectable section of said positionable tapered metering pin to engage said bore of said fixedly positioned fuel tube, for metering a given amount of fuel into said airstream;

sealing means positioned at the active end of said positionable throttle block;

means for causing said sealing means to be pressure abutted against the fuel dispensing bore of said fuel tube, for shutting off the flow of fuel from said fuel tube;

and means for preventing said metering element from being longitudinally displaced;

said preventing means comprising a peripheral groove around said fuel tube and further comprising locking means positioned in said peripheral groove, whereby said fuel tube is longitudinally fixedly positioned, but is permitted to assume selected angular orientations.

3. A carburetor comprising:

means defining an air passageway, for directing an airstream;

a movable throttle block having an airstream opening therein and movable across said passageway;

a tapered metering pin carried by said movable throttle block and extending across said opening from one side thereof through a lateral aperture in the other side of said opening; whereby said metering pin is also movable with said throttle block;

means, comprising a fixedly positioned fuel tube extending through said aperture and having a metering element incorporating a fuel dispensing bore telescopically embracing said metering pin, for dispensing fuel into said airstream;

said fuel dispensing bore being fixedly positioned in predetermined relation to said air passageway;

means for moving said throttle block for causing said airstream opening to throttle said airstream to a given extent, and for causing a selectable section of said tapered metering pin to occupy said bore of said fixedly positioned fuel tube, for metering a given amount of fuel into said airstream in accordance with the position of said block;

a sealing means movable with said block and surrounding said metering pin at said one side of said opening and being sealably engageable with said fuel dispensing bore when said throttle block is moved to a position closing said air passageway;

and means for preventing said metering element from being longitudinally displaced, said preventing means comprising a peripheral groove around said fuel tube and further comprising locking means positioned in said peripheral groove, whereby said fuel tube is longitudinally fixedly positioned, but is permitted to assume selected angular orientations.

4. A carburetor comprising:

means defining an air passageway, for directing an airstream;

a movable throttle block having an airstream opening therein and movable across said passageway;

a tapered metering pin carried by said movable throttle block and extending across said opening from one side thereof through a lateral aperture in the other side of said opening; whereby said metering pin is also movable with said throttle block;

means, comprising a fixedly positioned fuel tube extending through said aperture and having a metering element incorporating a fuel dispensing bore telescopically embracing said metering pin, for dispensing fuel into said airstream;

said fuel tube comprising a flexible tubing alignment sector;

said fuel dispensing bore being fixedly positioned in predetermined relation to said air passageway;

and means for moving said throttle block for causing said airstream opening to throttle said airstream to a given extent, and for causing a selectable section of said tapered metering pin to occupy said bore of said fixedly positioned fuel tube, for metering a given amount of fuel into said airstream in accordance with the position of said block.

5. A carburetor comprising:

means, comprising an air passageway, for establishing an airstream;

a positionable throttle block having an airstream opening therein;

a tapered metering pin mounted in said positionable throttle block;

one end of said tapered metering pin being mounted in a threaded insert that is threadedly engaged in said throttle block;

a sealing-retainer positioned at the active end of said throttle block;

the central portion of said tapered metering pin being supported by an interference fit into an axial opening of said sealing-retainer;

whereby said metering pin is also positionable;

means, comprising a fixedly positioned fuel tube, for dispensing fuel into said airstream;

said fuel tube comprising a fuel inlet, a flexible tubing alignment sector, and a metering element incorporating a fuel dispensing bore;

said fuel dispensing bore being fixedly positioned in a predetermined location of said airstream;

means for positioning said throttle block for causing said airstream opening thereof to throttle said airstream to a given extent, for causing a selectable section of said positionable tapered metering pin to engage said bore of said fixedly positioned fuel tube for metering a given amount of fuel into said airstream, and for causing said sealing-retainer to be pressure abutted against the fuel dispensing metering element of said fuel tube for shutting off the flow of fuel from said fuel tube.

6. The combination of claim 5 including means for preventing said metering element from being longitudinally displaced by the abutting pressure;

said preventing means comprising a peripheral groove around said metering element, and further comprising a locking stud positioned in said peripheral groove.

7. The combination of claim 6 wherein said fuel tube is longitudinally fixedly positioned by said groove and stud, but said fuel inlet is adapted to assume desired angular orientations.

8. The combination of claim 5 including means, comprising an idle speed adjustment screw, for preventing said abutment of said sealing-retainer against said fuel dispensing metering element, for providing an idle speed flow of fuel from said fuel tube.

* * * * *